US009774074B2

(12) United States Patent
Tsai et al.

(10) Patent No.: US 9,774,074 B2
(45) Date of Patent: Sep. 26, 2017

(54) MOBILE DEVICE AND MANUFACTURING METHOD THEREOF

(71) Applicant: HTC Corporation, Taoyuan, Taoyuan County (TW)

(72) Inventors: Tiao-Hsing Tsai, Taoyuan (TW); Chien-Pin Chiu, Taoyuan (TW); Li-Yuan Fang, Taoyuan (TW); Hsiao-Wei Wu, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 317 days.

(21) Appl. No.: 14/487,958

(22) Filed: Sep. 16, 2014

(65) Prior Publication Data

US 2016/0079656 A1 Mar. 17, 2016

(51) Int. Cl.

| | |
|---|---|
| ***H01Q 1/24*** | (2006.01) |
| ***H01Q 9/42*** | (2006.01) |
| ***H01Q 5/335*** | (2015.01) |
| *H01Q 5/321* | (2015.01) |
| *H01Q 5/328* | (2015.01) |

(52) U.S. Cl.

CPC ..... *H01Q 1/243* (2013.01); *H01Q 5/335* (2015.01); *H01Q 9/42* (2013.01); *H01Q 1/241* (2013.01); *H01Q 1/242* (2013.01); *H01Q 1/244* (2013.01); *H01Q 5/321* (2015.01); *H01Q 5/328* (2015.01)

(58) Field of Classification Search

CPC .. H01Q 1/24; H01Q 3/44; H01Q 5/00; H01Q 5/314; H01Q 5/335; H01Q 5/50; H01Q 9/42; H01Q 5/328; H01Q 5/321; H01Q 1/241–1/244; H01Q 9/0421; H01Q 9/14; H01Q 9/0442

USPC ..... 343/702, 752, 846, 876, 750

See application file for complete search history.

(56) References Cited

U.S. PATENT DOCUMENTS 3,852,759 A * 12/1974 Felsenheld ..... H01Q 1/362 343/725

6,034,636 A * 3/2000 Saitoh ..... H01Q 9/0421 343/700 MS (Continued)

FOREIGN PATENT DOCUMENTS

CN 1254205 A 5/2000

EP 1 052 722 A2 11/2000

(Continued)

OTHER PUBLICATIONS

The ARRL Antenna Book, Gerald (Jerry) Hall , 1988.*

*Primary Examiner* — Hoang Nguyen

*Assistant Examiner* — Awat Salih

(74) *Attorney, Agent, or Firm* — Birch, Stewart, Kolasch & Birch, LLP

(57) ABSTRACT

A mobile device includes a ground element, a radiation element, a first short-circuited element, a second short-circuited element, and a switch element. The radiation element has a feeding point, a fixed grounding point, and a switchable grounding point. The fixed grounding point is coupled through the first short-circuited element to the ground element. The switchable grounding point is coupled through the second short-circuited element and the switch element to the ground element. An antenna structure is formed by the radiation element, the first short-circuited element, the second short-circuited element, and the switch element.

18 Claims, 6 Drawing Sheets

(56) References Cited

U.S. PATENT DOCUMENTS 6,255,994 B1 * 7/2001 Saito ..... H01Q 1/38 343/700 MS
6,515,625 B1 * 2/2003 Johnson ..... H01Q 9/0421 343/700 MS
6,542,126 B2 4/2003 Bahr et al.
6,662,028 B1 * 12/2003 Hayes ..... H01Q 1/243 343/908
7,324,054 B2 * 1/2008 Ozkar ..... H01Q 5/00 343/702
7,616,158 B2 * 11/2009 Mak ..... H01Q 1/243 343/700 MS
9,437,928 B2 * 9/2016 Li ..... H01Q 9/04
2006/0097918 A1 * 5/2006 Oshiyama ..... H01Q 1/243 343/700 MS
2009/0128428 A1 * 5/2009 Ishizuka ..... H01Q 1/243 343/702
2009/0167617 A1 * 7/2009 Nishio ..... H01Q 9/0421 343/702
2011/0128200 A1 * 6/2011 Hossain ..... H01Q 7/00 343/745
2012/0019420 A1 * 1/2012 Caimi ..... H01Q 1/243 343/702
2012/0287014 A1 * 11/2012 Tseng ..... H01Q 1/243 343/876
2013/0099996 A1 * 4/2013 Tseng ..... H01Q 1/243 343/876
2013/0169490 A1 * 7/2013 Pascolini ..... H01Q 5/357 343/702
2013/0241798 A1 * 9/2013 Lee ..... H01Q 1/50 343/876
2013/0257659 A1 * 10/2013 Darnell ..... H01Q 1/243 343/702
2014/0128007 A1 * 5/2014 Chen ..... H04B 1/18 455/77
2014/0306857 A1 * 10/2014 Bevelacqua ..... H01Q 1/243 343/750
2014/0354508 A1 * 12/2014 Lee ..... H01Q 1/48 343/860
2015/0002348 A1 * 1/2015 Wong ..... H01Q 1/243 343/724
2015/0022422 A1 * 1/2015 Chang ..... H01Q 1/243 343/861
2015/0054701 A1 * 2/2015 Kim ..... H01Q 9/0442 343/750
2015/0200448 A1 * 7/2015 Tsai ..... H01Q 1/243 343/702
2015/0311579 A1 * 10/2015 Irci ..... H01Q 1/243 343/702
2016/0276742 A1 * 9/2016 Yu ..... H01Q 1/48

FOREIGN PATENT DOCUMENTS

TW 201409829 A 3/2014
TW 201421794 A 6/2014

* cited by examiner

MOBILE DEVICE AND MANUFACTURING METHOD THEREOF

BACKGROUND OF THE INVENTION

Field of the Invention

The subject application generally relates to a mobile device, and more particularly, to a mobile device including an antenna structure.

Description of the Related Art

With the advancement of mobile communication technology, mobile devices such as portable computers, mobile phones, multimedia players, and other hybrid functional portable electronic devices have become more common. To satisfy the demands of users, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Traditionally, a metal element with a fixed size is used as the main body of an antenna. The metal element is a half of wavelength or a quarter wavelength in length, and the wavelength corresponds to the desired frequency band. Traditional designs limit the size and shape of the metal element, such that it is difficult to design the appearance of antenna. Moreover, a metal element with a fixed size cannot be used to cover multiple frequency bands.

BRIEF SUMMARY OF THE INVENTION

In a preferred embodiment, the subject application is directed to a mobile device, including: a ground element; a radiation element, having a feeding point, a fixed grounding point, and a switchable grounding point; a first short-circuited element, wherein the fixed grounding point is coupled through the first short-circuited element to the ground element; a switch element; and a second short-circuited element, wherein the switchable grounding point is coupled through the second short-circuited element and the switch element to the ground element; wherein an antenna structure is formed by the radiation element, the first short-circuited element, the second short-circuited element, and the switch element.

In some embodiments, the antenna structure is capable of operating in multiple frequency bands by selectively closing or opening the switch element. In some embodiments, the antenna structure further includes: a variable capacitor, wherein a signal source is coupled through the variable capacitor to the feeding point. In some embodiments, the antenna structure is capable of operating in multiple frequency bands by adjusting a capacitance of the variable capacitor. In some embodiments, the radiation element has a first end and a second end which are opposite to each other, the fixed grounding point is more adjacent to the second end than the switchable grounding point, the switchable grounding point is more adjacent to the first end than the fixed grounding point, and the feeding point is adjacent to the fixed grounding point. In some embodiments, when the switch element is open and the variable capacitor provides a relatively large capacitance, a first resonant path is formed extending from the fixed grounding point to the left to the first end, and the first resonant path is excited to generate a first low-frequency band. In some embodiments, the first low-frequency band is substantially from 704 MHz to 850 MHz. In some embodiments, the relatively large capacitance is about 3.3 pF. In some embodiments, when the switch element is closed and the variable capacitor provides a relatively small capacitance, a second resonant path is extending formed from the switchable grounding point to the right to the second end, and the second resonant path is excited to generate a second low-frequency band. In some embodiments, the second low-frequency band is substantially from 850 MHz to 960 MHz. In some embodiments, the relatively small capacitance is about 0.8 pF. In some embodiments, a length of the first resonant path is about 1.1 to 1.5 times that of the second resonant path. In some embodiments, the first resonant path is at least partially overlaps with the second resonant path, and the first resonant path and the second resonant path extend in reverse directions. In some embodiments, when the switch element is open and the variable capacitor provides a relatively large capacitance, a third resonant path is formed from the fixed grounding point to the second end, and the third resonant path is excited to generate a high-frequency band. In some embodiments, the high-frequency band is substantially from 1710 MHz to 2170 MHz and further from 2300 MHz to 2700 MHz. In some embodiments, when the switch element is closed and the variable capacitor provides a relatively small capacitance, a third resonant path is formed from the fixed grounding point to the second end, and the third resonant path is excited to generate a high-frequency band. In some embodiments, the high-frequency band is substantially from 2170 MHz to 2300 MHz. In some embodiments, the radiation element substantially has a long and narrow rectangular plane. In some embodiments, the radiation element is substantially parallel to the ground element, and the first short-circuited element and the second short-circuited element are both substantially perpendicular to the radiation element and the ground element. In some embodiments, each of the first short-circuited element and the second short-circuited element is a metal spring. In some embodiments, the mobile device further includes: a housing, wherein a portion of the housing is formed by the radiation element. In some embodiments, the mobile device further includes: one or more electronic components, disposed on the radiation element of the antenna structure.

In a preferred embodiment, the subject application is directed to a method for manufacturing a mobile device, including the steps of: providing a ground element, a radiation element, a first short-circuited element, a second short-circuited element, and a switch element; coupling a feeding point of the radiation element to a signal source; coupling a fixed grounding point of the radiation element through the first short-circuited element to the ground element; coupling a switchable grounding point of the radiation element through the second short-circuited element and the switch element to the ground element; and using the radiation element, the first short-circuited element, the second short-circuited element, and the switch element to form an antenna structure.

In some embodiments, the method further includes: coupling a variable capacitor between the signal source and the feeding point to form a portion of the antenna structure.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1A:
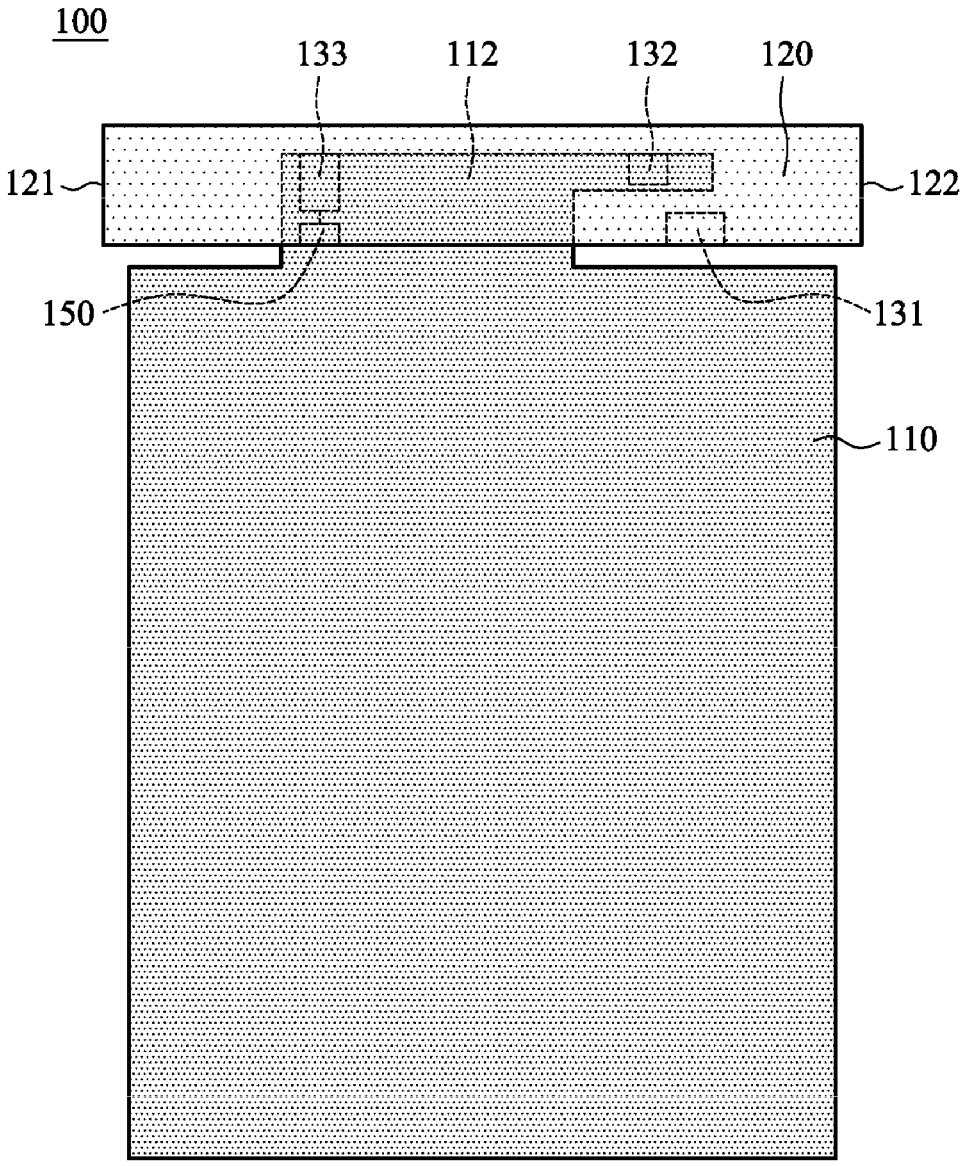
FIG. 1A is a top view of a mobile device according to an embodiment of the invention.
Figure 1B:
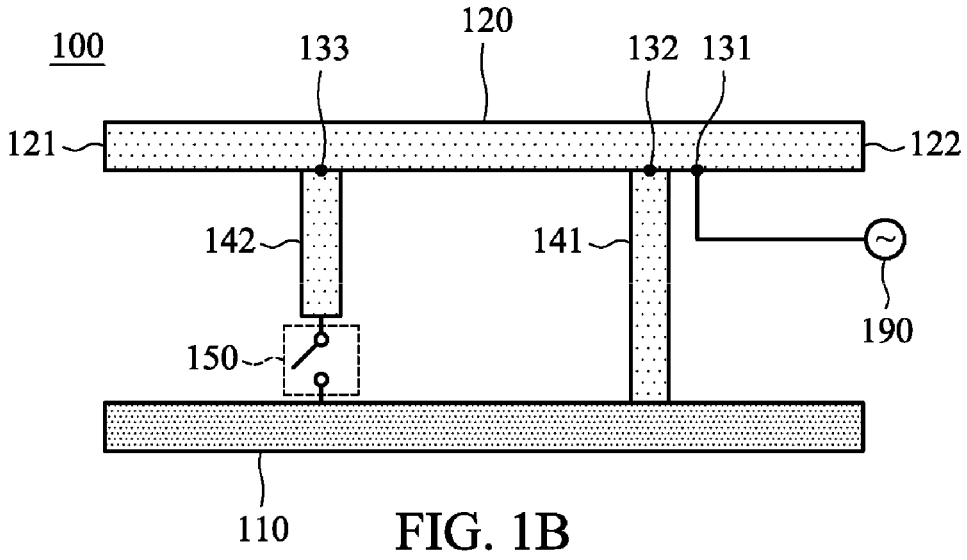
FIG. 1B is a side view of a mobile device according to an embodiment of the invention.

FIG. 1A is a top view of a mobile device 100 according to an embodiment of the invention. FIG. 1B is a side view of the mobile device 100 according to an embodiment of the invention. For example, the mobile device 100 may be a smartphone, a tablet computer, or a notebook computer. Please refer to FIG. 1A and FIG. 1B together. In the embodiment of FIG. 1A and FIG. 1B, the mobile device 100 at least includes a ground element 110, a radiation element 120, a first short-circuited element 141, a second short-circuited element 142, and a switch element 150. The ground element 110, the radiation element 120, the first short-circuited element 141, and the second short-circuited element 142 may be made of metal materials, such as copper, silver, aluminum, iron, or their alloys. The ground element 110 may be a metal plane disposed on a dielectric substrate (not shown), such as an FR4 (Flame Retardant 4) substrate or a system circuit board. An antenna structure is formed by the radiation element 120, the first short-circuited element 141, the second short-circuited element 142, and the switch element 150. It should be understood that in addition to the antenna structure, the mobile device 100 may further include other components, such as a display device, a processor, a speaker, a touch control module, a power supply module, and a housing (not shown).

The ground element 110 may include a protruded grounding portion 112. The protruded grounding portion 112 may substantially have an inverted L-shape. The radiation element 120 may substantially have a long and narrow rectangular plane. The radiation element 120 has a feeding point 131, a fixed grounding point 132, and a switchable grounding point 133. More particularly, the radiation element 120 has a first end 121 and a second end 122 which are opposite to each other. The fixed grounding point 132 is more adjacent to the second end 122 than the switchable grounding point 133. The switchable grounding point 133 is more adjacent to the first end 121 than the fixed grounding point 132. The feeding point 131 is adjacent to the fixed grounding point 132. The radiation element 120 may has a different shape, such as an L-shape, a J-shape, or a U-shape. The feeding point 131 is coupled to a signal source 190. For example, the signal source 190 may be an RF (Radio Frequency) module for exciting the antenna structure. The fixed grounding point 132 is coupled through the first short-circuited element 141 to the protruded grounding portion 112 of the ground element 110. The switchable grounding point 133 is coupled through the second short-circuited element 142 and the switch element 150 to the protruded grounding portion 112 of the ground element 110.

As shown in FIG. 1B, the radiation element 120 may be substantially parallel to the ground element 110, and the first short-circuited element 141 and the second short-circuited element 142 may be both substantially perpendicular to the radiation element 120 and the ground element 110. Each of the first short-circuited element 141 and the second short-circuited element 142 may be a pogo pin or a metal spring. The switch element 150 may be a transmission gate, a switch, or an MOSFET (Metal-Oxide-Semiconductor Field-Effect Transistor). The switch element 150 is selectively closed or open according to a control signal from a processer (not shown). The control signal may be determined by a user input signal, or by a detection result of a detector (not shown) for detecting frequency of surrounding electromagnetic waves. When the switch element 150 is closed, the radiation element 120 is grounded through both the fixed grounding point 132 and the switchable grounding point 133. When the switch element 150 is open, the radiation element 120 is merely grounded through the fixed grounding point 132. The two switching states provide different resonant paths and different impedance matching. As a result, by selectively closing or opening the switch element 150, the antenna structure is capable of operating in multiple frequency bands. The invention can achieve the effect of multiband operations and wideband operations without changing the total size of the antenna structure.

Figure 2:
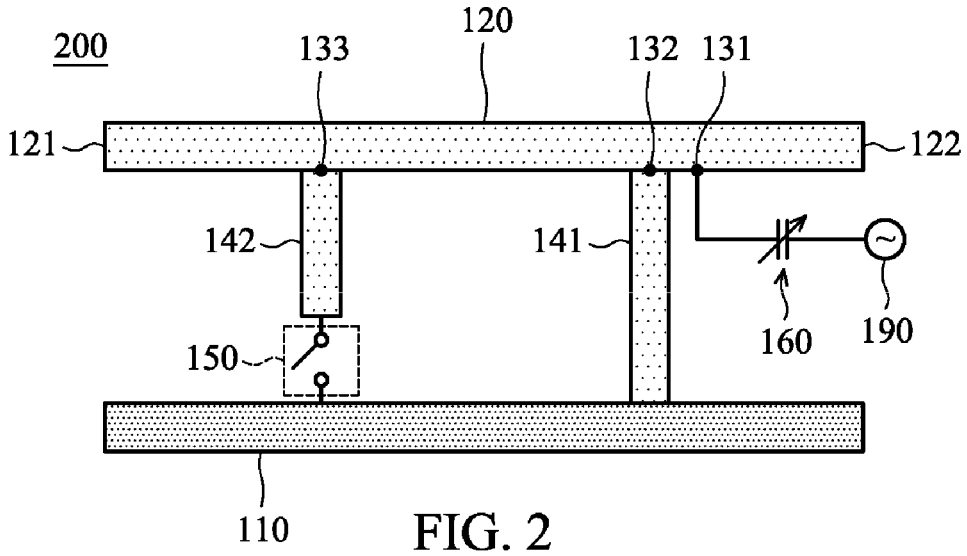
FIG. 2 is a side view of a mobile device according to an embodiment of the invention.

FIG. 2 is a side view of a mobile device 200 according to an embodiment of the invention. FIG. 2 is similar to FIG. 1B. The difference between the two embodiments is that the antenna structure of the mobile device 200 further includes a variable capacitor 160. The variable capacitor 160 is coupled between the signal source 190 and the feeding point 131. That is, a feeding signal of the signal source 190 is fed through the variable capacitor 160 and used to excite the antenna structure. The variable capacitor 160 may be a varactor diode. The variable capacitor 160 generates different capacitances according to a control signal from a processor (not shown). For example, the capacitance of the variable capacitor 160 may be selected among 0.8 pF, 1.2 pF, 1.6 pF, and 3.3 pF. The control signal may be determined by a user input signal, or by a detection result of a detector (not shown) for detecting frequency of surrounding electromagnetic waves. The variable capacitor 160 is configured to change the impedance value of the feeding path of the antenna structure, thereby controlling the effective resonant length of the antenna structure. By adjusting the capacitance of the variable capacitor 160, the antenna structure is capable of operating in multiple frequency bands. Other features of the mobile device 200 of FIG. 2 are similar to those of the mobile device 100 of FIG. 1A and FIG. 1B. Therefore, the two embodiments can achieve similar levels of performance.

It should be noted that the side views of FIG. 1B and FIG. 2 are used for readers to easily understand the connection relationship between elements. As a matter of fact, the switch element 150, the variable capacitor 160, and the signal source 190 may all be directly disposed on the surface of the ground element 110.

Figure 3:
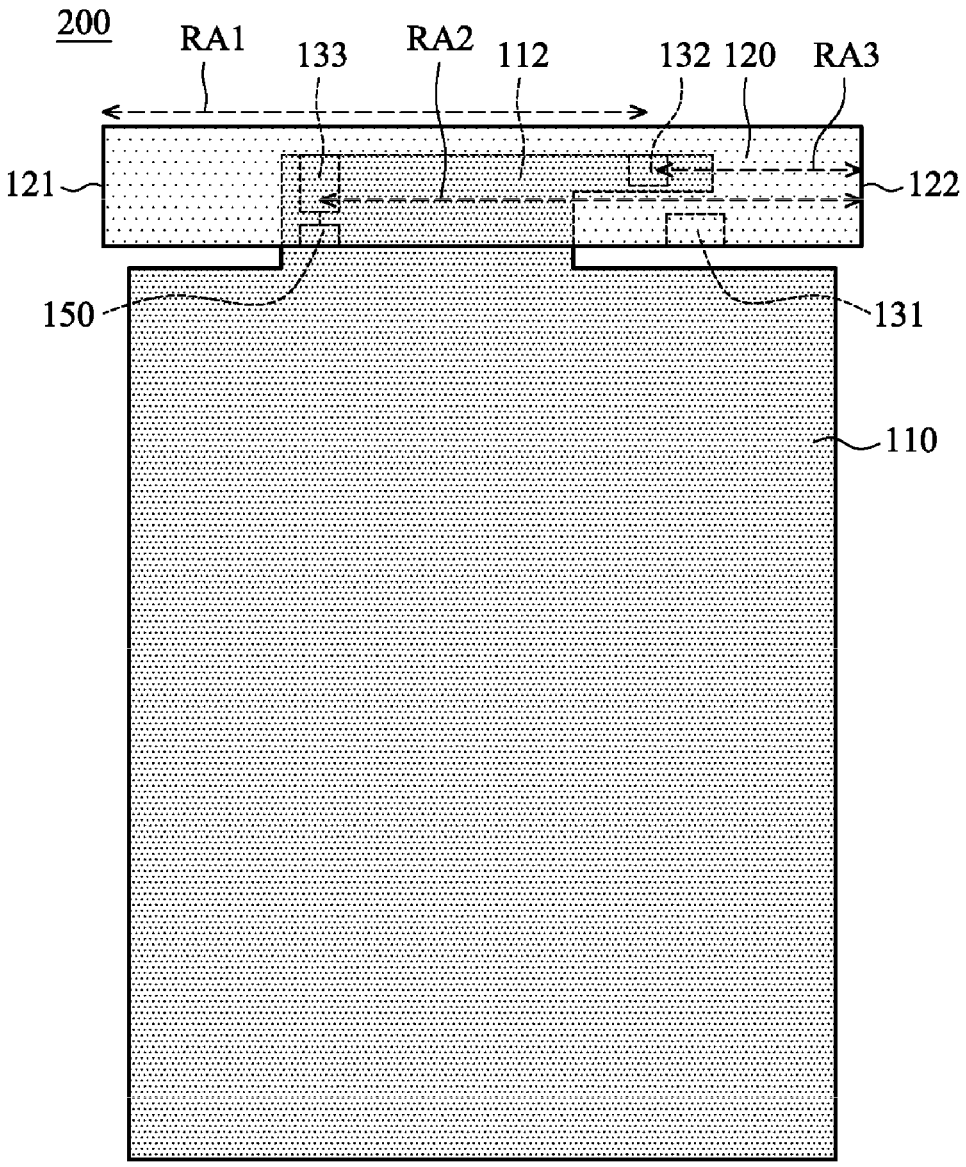
FIG. 3 is a top view of a mobile device according to an embodiment of the invention.

FIG. 3 is a top view of a mobile device 300 according to an embodiment of the invention. In the embodiment of FIG. 3, the switch element 150 and the variable capacitor 160 are used together to improve the performance of the antenna structure, and their antenna theory will be illustrated as follows. When the switch element 150 is open and the variable capacitor 160 provides a relatively large capacitance C1, a first resonant path RA1 is formed extending from the fixed grounding point 132 to the left to the first end 121 (i.e., the open end) of the radiation element 120, and the first resonant path RA1 is excited to generate a first low-frequency band. When the switch element 150 is closed and the variable capacitor 160 provides a relatively small capacitance C2, a second resonant path RA2 is formed extending from the switchable grounding point 133 to the right to the second end 122 (i.e., the open end) of the radiation element 120, and the second resonant path RA2 is excited to generate a second low-frequency band. The first resonant path RA1 at least partially overlaps with the second resonant path RA2, and their two open ends are opposite to each other. Preferably, the length of the first resonant path RA1 is about 1.1 to 1.5 times that of the second resonant path RA2. In this embodiment, the above resonant paths have different effective lengths, and they extend in reverse directions. Besides, when the switch element 150 is open and the variable capacitor 160 provides a relatively large capacitance C1, a third resonant path RA3 is formed from the fixed grounding point 132 to the second end 122 of the radiation element 120, and the third resonant path RA3 is excited to generate a first high-frequency band. Furthermore, when the switch element 150 is closed and the variable capacitor 160 provides a relatively small capacitance C2, the third resonant path RA3 is affected by the electric characteristics of the variable capacitor 160, such that the original high-frequency band generated by the third resonant path RA3 shifts to higher frequency to form a second high-frequency band.

Figure 4:
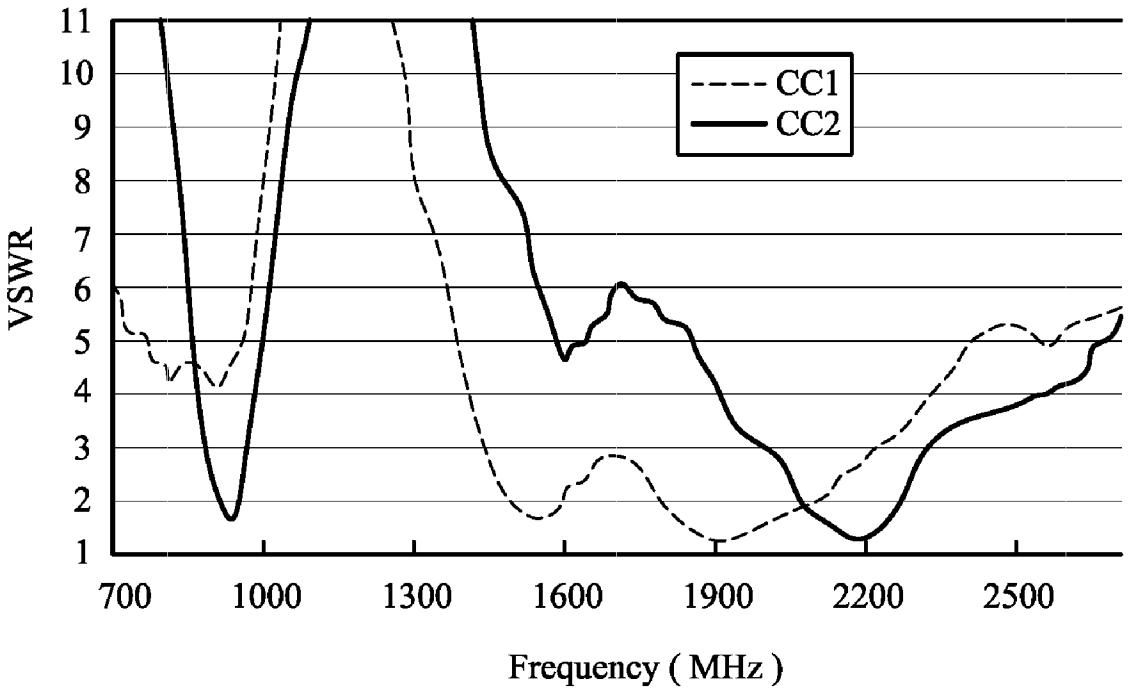
FIG. 4 is a diagram of operation bands of an antenna structure of a mobile device according to an embodiment of the invention.

FIG. 4 is a diagram of operation bands of the antenna structure of the mobile device 300 according to an embodiment of the invention. The horizontal axis represents the operation frequency, and the vertical axis represents the VSWR (Voltage Standing Wave Ratio). The first curve CC1 means the relationship between the operation frequency and the VSWR of the antenna structure when the switch element 150 is open and the variable capacitor 160 provides a relatively large capacitance (e.g., 3.3 pF). According to the first curve CC1, the first low-frequency band of the antenna structure is substantially from 704 MHz to 850 MHz, and the high-frequency band of the antenna structure is substantially from 1710 MHz to 2170 MHz and further from 2300 MHz to 2700 MHz. The second curve CC2 means the relationship between the operation frequency and the VSWR of the antenna structure when the switch element 150 is closed and the variable capacitor 160 provides a relatively small capacitance (e.g., 0.8 pF). According to the second curve CC2, the second low-frequency band of the antenna structure is substantially from 850 MHz to 960 MHz, and the high-frequency band of the antenna structure is substantially from 2170 MHz to 2300 MHz. As a result, by appropriately controlling the switch element 150 and adjusting the capacitance of the variable capacitor 160, the bandwidths of low-frequency and high-frequency bands of the antenna structure are both significantly increased, as shown in the operation band figure. The antenna structure of the invention at least covers multiband Operations of LTE B17/B13/B20/GSM850/900/DCS1800/PCS1900/UMTS2100/LTE B38/B40/B41/B7.

According to measurement results, the antenna structure of the mobile device 200 has an antenna efficiency greater than 44% in both the first low-frequency band and the second low-frequency band, and it also has an antenna efficiency greater than 70.4% in the high-frequency band. This antenna efficiency meets the requirements for applications in general mobile communication devices. Generally speaking, the mobile device 200 has a length of about 157 mm, a width of about 76 mm, and a height of about 4 mm. In addition, the antenna structure has a length of about 13 mm, a width of about 76 mm, and a height of about 0.8 mm. The mobile device and antenna structure of the invention can support multiband operations and wideband operations even if their total size is very small. Therefore, the invention is suitable for application in a variety of small wireless communication produces.

Figure 5:
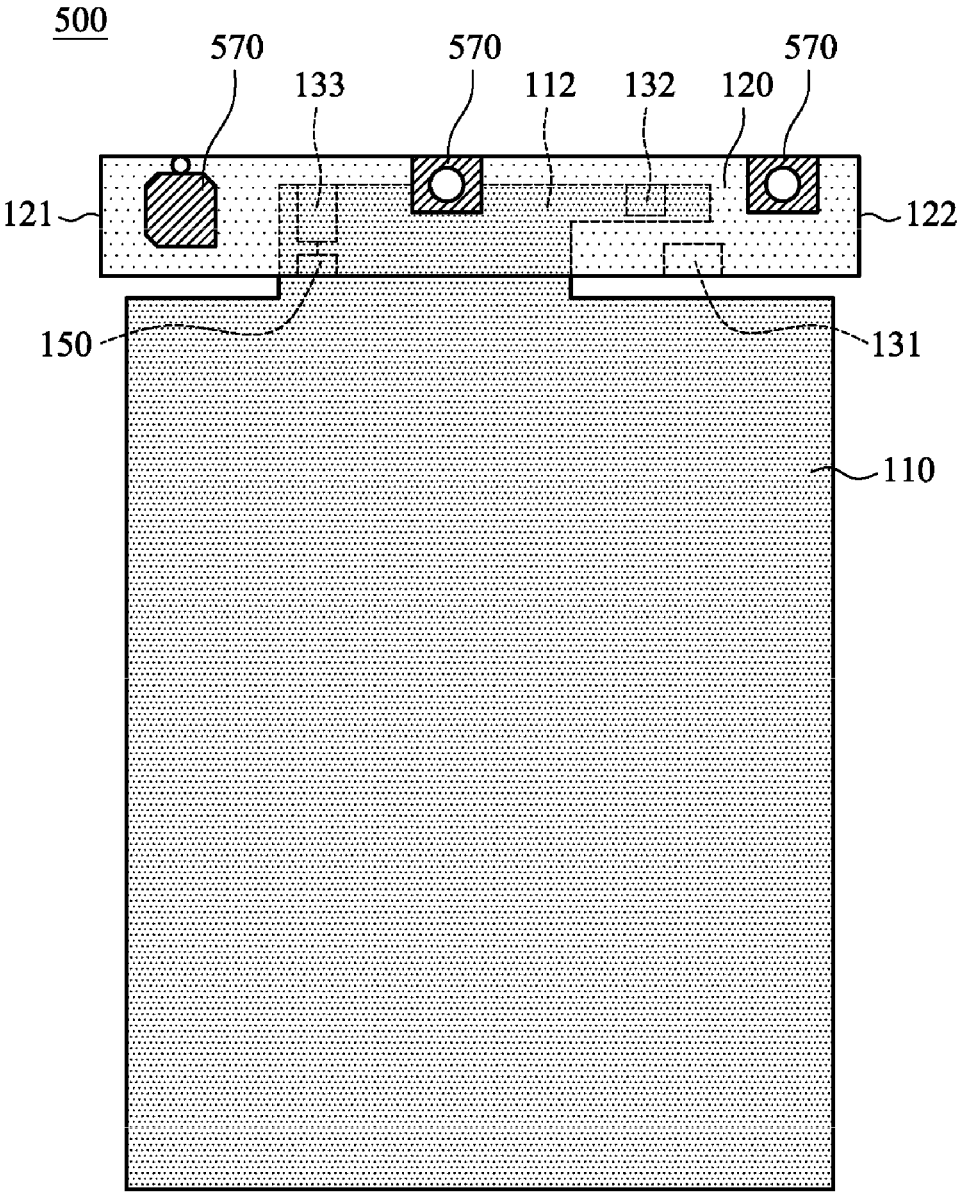
FIG. 5 is a side view of a mobile device according to an embodiment of the invention.

FIG. 5 is a side view of a mobile device 500 according to an embodiment of the invention. FIG. 5 is similar to FIG. 1A. The difference between the two embodiments is that the mobile device 500 further includes one or more electronic components 570, such as a speaker, a camera, and/or a headphone jack. The electronic components 570 are disposed on the radiation element 120 of the antenna structure of the mobile device 500, and they may be considered a portion of the antenna structure. Accordingly, the electronic components 570 do not influence the radiation performance of the antenna structure very much. In the embodiment of FIG. 5, the antenna structure may load the one or more electronic components 570 and may be appropriately integrated therewith, thereby using less inner design space in the mobile device 500. Furthermore, the radiation element 120 may be designed as a portion of a housing of the mobile device 500. With such a design, the housing formed by the radiation element 120 is considered a metal antenna resonator (i.e., resonant cavity), and it can enhance the radiation efficiency of the antenna structure, without affecting the radiation pattern of the antenna structure. The metal housing, which originally interferes with the antenna structure, may be converted into a portion of the antenna structure. Other features of the mobile device 500 of FIG. 5 are similar to those of the mobile device 100 of FIG. 1A and FIG. 1B. Therefore, the two embodiments can achieve similar levels of performance.

Figure 6:
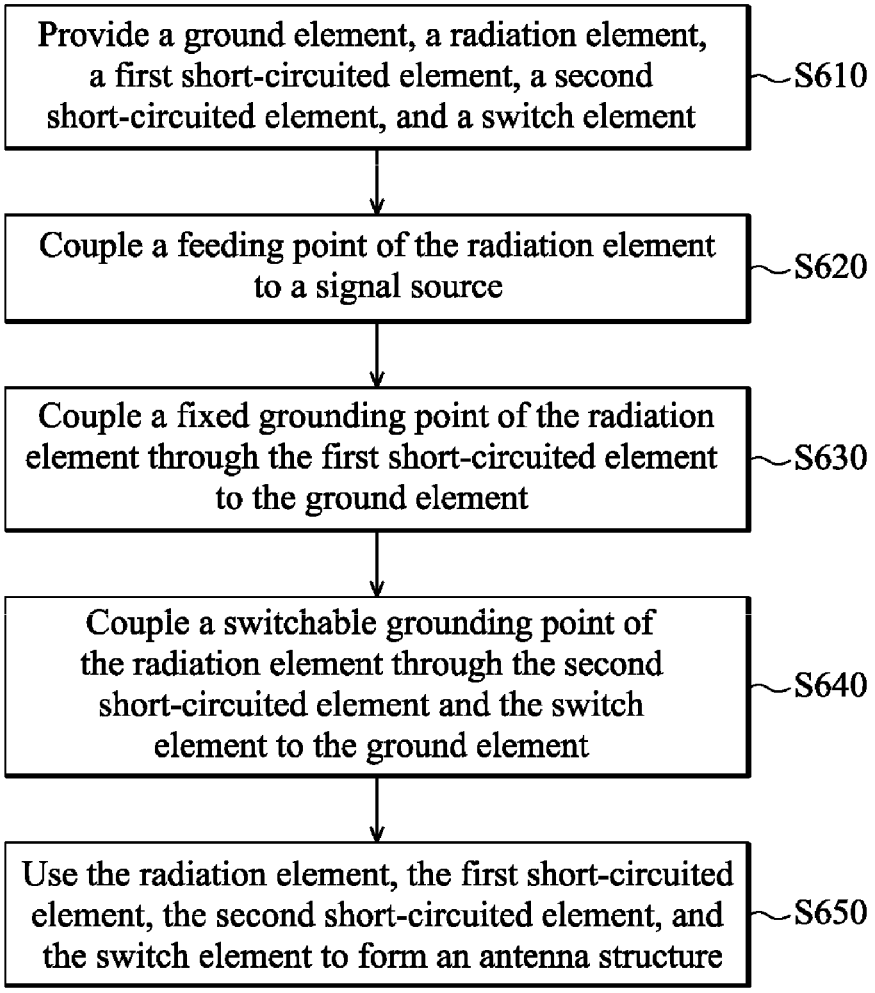
FIG. 6 is a flowchart of a method for manufacturing a mobile device according to an embodiment of the invention.

FIG. 6 is a flowchart of a method for manufacturing a mobile device according to an embodiment of the invention. To begin, in step S610, a ground element, a radiation element, a first short-circuited element, a second short-circuited element, and a switch element are provided. In step S620, a feeding point of the radiation element is coupled to a signal source. In step S630, a fixed grounding point of the radiation element is coupled through the first short-circuited element to the ground element. In step S640, a switchable grounding point of the radiation element is coupled through the second short-circuited element and the switch element to the ground element. Finally, the radiation element, the first short-circuited element, the second short-circuited element, and the switch element are used to form an antenna structure. The method may further include the step of coupling a variable capacitor between the signal source and the feeding point to form a portion of the antenna structure. It should be understood that the above steps are not required to be performed in order, and any one or more features of the embodiments of FIGS. 1-5 may be applied to the manufacturing method of FIG. 6.

The invention provides a novel mobile device including a small-size and multiband antenna structure. By controlling a switch element and/or a variable capacitor of the antenna structure, the antenna structure can support multiband and wideband operations without changing its total size. Therefore, the invention may be applied to current mobile communication devices with multiple functions.

It should be noted that the above element sizes, element shapes, and frequency ranges are not limitations of the invention. An antenna designer can fine-tune these settings or values according to different requirements. The mobile device and the manufacturing method of the invention are not limited to the configurations of FIGS. 1-6. The invention may merely include any one or more features of any one or more embodiments of FIGS. 1-6. In other words, not all of the features displayed in the figures should be implemented in the mobile device and the manufacturing method of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for the ordinal term) to distinguish the claim elements.

The embodiments of the disclosure are considered exemplary only, not limitations. It will be apparent to those skilled in the art that various modifications and variations can be made in the invention, the true scope of the disclosed embodiments being indicated by the following claims and their equivalents.

What is claimed is:

1. A mobile device, comprising:

a ground element;

a radiation element, having a feeding point, a fixed grounding point, and a switchable grounding point;

a first short-circuited element, wherein the fixed grounding point is coupled through the first short-circuited element to the ground element;

a switch element; and a second short-circuited element, wherein the switchable grounding point is coupled through the second short-circuited element and the switch element to the ground element, wherein an antenna structure is formed by the radiation element, the first short-circuited element, the second short-circuited element, and the switch element, wherein the fixed grounding point is substantially positioned between the feeding point and the switchable grounding point, wherein the antenna structure further comprises:

a variable capacitor, wherein a signal source is coupled through the variable capacitor to the feeding point, wherein the radiation element has a first end and a second end which are opposite to each other, the fixed grounding point is more adjacent to the second end than the switchable grounding point, the switchable grounding point is more adjacent to the first end than the fixed grounding point, and the feeding point is adjacent to the fixed grounding point, wherein when the switch element is open and the variable capacitor provides a relatively large capacitance, a first resonant path is formed extending from the fixed grounding point to the left to the first end, and the first resonant path is excited to generate a first low-frequency band, wherein when the switch element is closed and the variable capacitor provides a relatively small capacitance, a second resonant path is formed extending from the switchable grounding point to the right to the second end, and the second resonant path is excited to generate a second low-frequency band, and wherein when the switch element is open and the variable capacitor provides a relatively large capacitance, a third resonant path is formed from the fixed grounding point to the second end, and the third resonant path is excited to generate a high-frequency band.

2. The mobile device as claimed in claim 1, wherein the antenna structure is capable of operating in multiple frequency bands by selectively closing or opening the switch element.

3. The mobile device as claimed in claim 1, wherein the antenna structure is capable of operating in multiple frequency bands by adjusting a capacitance of the variable capacitor.

4. The mobile device as claimed in claim 1, wherein the first low-frequency band is substantially from 704 MHz to 850 MHz.

5. The mobile device as claimed in claim 1, wherein the relatively large capacitance is about 3.3 pF.

6. The mobile device as claimed in claim 1, wherein the second low-frequency band is substantially from 850 MHz to 960 MHz.

7. The mobile device as claimed in claim 1, wherein the relatively small capacitance is about 0.8 pF.

8. The mobile device as claimed in claim 1, wherein a length of the first resonant path is about 1.1 to 1.5 times that of the second resonant path.

9. The mobile device as claimed in claim 1, wherein the first resonant path at least partially overlaps with the second resonant path, and the first resonant path and the second resonant path extend in reverse directions.

10. The mobile device as claimed in claim 1, wherein the high-frequency band is substantially from 1710 MHz to 2170 MHz and further from 2300 MHz to 2700 MHz.

11. The mobile device as claimed in claim 1, wherein when the switch element is closed and the variable capacitor provides a relatively small capacitance, a third resonant path is formed from the fixed grounding point to the second end, and the third resonant path is excited to generate a high-frequency band.

12. The mobile device as claimed in claim 11, wherein the high-frequency band is substantially from 2170 MHz to 2300 MHz.

13. The mobile device as claimed in claim 1, wherein the radiation element substantially has a long and narrow rectangular plane.

14. The mobile device as claimed in claim 1, wherein the radiation element is substantially parallel to the ground element, and the first short-circuited element and the second short-circuited element are both substantially perpendicular to the radiation element and the ground element.

15. The mobile device as claimed in claim 1, wherein each of the first short-circuited element and the second short-circuited element is a metal spring.

16. The mobile device as claimed in claim 1, wherein the radiation element is a portion of a housing.

17. The mobile device as claimed in claim 1, further comprising:

one or more electronic components disposed on the radiation element of the antenna structure.

18. A method for manufacturing a mobile device, comprising the steps of:

providing a ground element, a radiation element, a first short-circuited element, a second short-circuited element, and a switch element;

coupling a feeding point of the radiation element to a signal source;

coupling a fixed grounding point of the radiation element through the first short-circuited element to the ground element;

coupling a switchable grounding point of the radiation element through the second short-circuited element and the switch element to the ground element; and using the radiation element, the first short-circuited element, the second short-circuited element, and the switch element to form an antenna structure, wherein the fixed grounding point is substantially positioned between the feeding point and the switchable grounding point, wherein the antenna structure further comprises a variable capacitor, and a signal source is coupled through the variable capacitor to the feeding point, wherein the radiation element has a first end and a second end which are opposite to each other, the fixed grounding point is more adjacent to the second end than the switchable grounding point, the switchable grounding point is more adjacent to the first end than the fixed grounding point, and the feeding point is adjacent to the fixed grounding point, wherein when the switch element is open and the variable capacitor provides a relatively large capacitance, a first resonant path is formed extending from the fixed grounding point to the left to the first end, and the first resonant path is excited to generate a first low-frequency band, wherein when the switch element is closed and the variable capacitor provides a relatively small capacitance, a second resonant path is formed extending from the switchable grounding point to the right to the second end, and the second resonant path is excited to generate a second low-frequency band, and wherein when the switch element is open and the variable capacitor provides a relatively large capacitance, a third resonant path is formed from the fixed grounding point to the second end, and the third resonant path is excited to generate a high-frequency band.

* * * * *